US011753846B2

(12) United States Patent
Spurgeon et al.

(10) Patent No.: US 11,753,846 B2
(45) Date of Patent: Sep. 12, 2023

(54) FOLDING SUPPORT ASSEMBLY FOR FENCE SYSTEMS

(71) Applicant: Iron Hedge, LLC, Buhler, KS (US)

(72) Inventors: Eric J. Spurgeon, Buhler, KS (US); Dana Brensing, Buhler, KS (US); John C. Kuenzi, Sabetha, KS (US)

(73) Assignee: Iron Hedge, LLC, Buhler, KS (US)

( * ) Notice: Subject to any disclaimer, the term of this patent is extended or adjusted under 35 U.S.C. 154(b) by 0 days.

(21) Appl. No.: 17/995,364

(22) PCT Filed: May 4, 2021

(86) PCT No.: PCT/US2021/070501
§ 371 (c)(1),
(2) Date: Oct. 3, 2022

(87) PCT Pub. No.: WO2021/226625
PCT Pub. Date: Nov. 11, 2021

(65) Prior Publication Data

US 2023/0071599 A1 Mar. 9, 2023

Related U.S. Application Data

(60) Provisional application No. 62/704,414, filed on May 8, 2020.

(51) Int. Cl.
*E04H 17/02* (2006.01)

(52) U.S. Cl.
CPC ..... *E04H 17/127* (2021.01)

(58) Field of Classification Search
CPC ..... E04H 17/00; E04H 17/02; E04H 17/06; E04H 17/08; E04H 17/10; E04H 17/124;
(Continued)

(56) References Cited

U.S. PATENT DOCUMENTS 475,865 A * 5/1892 Hudson ..... E04H 17/08 256/45
491,440 A * 2/1893 McCreedy ..... E04H 17/08 256/36

(Continued)

FOREIGN PATENT DOCUMENTS

AU 2019280052 A1 7/2020
CN 110318576 A 10/2019

(Continued)

OTHER PUBLICATIONS

Cheng, et al., A Kind Of Security Isolation Net For Electric Power Overhaul, This is a machine translation of a foreign patent originally published as CN110318576A on Oct. 11, 2019 in China.

(Continued)

*Primary Examiner* — Jonathan P Masinick
(74) *Attorney, Agent, or Firm* — Coughlin Law Office LLC; Daniel J. Coughlin; Stuart M. Aller

(57) ABSTRACT

A folding corner assembly for rapid and efficient installation of a fence post with support, especially for a corner assembly or endpoint. A brace is pivotally mounted between a first post sleeve and a second post sleeve. The first post sleeve and second post sleeve fold to a position approximately parallel with the brace in a storage configuration and unfold to a deployed configuration. An angle support pivotally mounted between a post extending from the first post sleeve and the second post sleeve is extendable by means of a slip joint. A stretch mechanism extends upwardly from the brace and slides along the brace. A tensioner mounted between the first post and the stretch mechanism maintains the stretch position of the stretch mechanism relative to the end post. A plurality of markings longitudinally spaced apart on the brace indicate a stretch specification.

38 Claims, 11 Drawing Sheets

(58) Field of Classification Search
CPC ..... E04H 17/127; E04H 17/131; E04H 17/20; E04H 17/23; E04H 17/26; E04H 17/261; E04H 17/266
See application file for complete search history.

(56) References Cited

U.S. PATENT DOCUMENTS

| | | | | |
|---|---|---|---|---|
| 512,047 | A * | 1/1894 | Moore | E04H 17/08 256/37 |
| 523,992 | A * | 8/1894 | Phelps | E04H 17/08 256/37 |
| 547,858 | A * | 10/1895 | Neff | E04H 17/10 256/39 |
| 560,364 | A * | 5/1896 | Owens | E04H 17/08 52/149 |
| 761,871 | A * | 6/1904 | Braun | E04H 17/08 242/159 |
| 1,764,207 | A | 6/1930 | Johnson | |
| 4,349,181 | A * | 9/1982 | Asher | E04H 17/08 256/22 |
| 4,479,636 | A | 10/1984 | King | |
| 4,893,787 | A | 1/1990 | Watson | |
| 5,061,109 | A | 10/1991 | Miller | |
| 5,192,055 | A | 3/1993 | Griggs et al. | |
| 5,649,690 | A * | 7/1997 | Kilmer | E04H 17/08 248/156 |
| 6,705,598 | B2 * | 3/2004 | Collins | E04H 17/08 256/65.05 |
| 6,826,818 | B2 * | 12/2004 | Sax | E04H 17/06 52/223.6 |
| 7,044,449 | B2 | 5/2006 | Wink | |
| 9,328,530 | B2 | 5/2016 | Bailey et al. | |
| 9,732,540 | B1 | 8/2017 | Jansen | |
| 10,036,180 | B1 | 7/2018 | Jansen | |
| 10,704,279 | B2 | 7/2020 | Hohmann et al. | |
| 2003/0042475 | A1 | 3/2003 | Passafuma | |
| 2013/0256619 | A1 | 10/2013 | Bailey et al. | |
| 2014/0105686 | A1 | 4/2014 | Southworth | |
| 2018/0038129 | A1 | 2/2018 | Anderson | |
| 2020/0318380 | A1 | 10/2020 | Xuewei et al. | |
| 2020/0407990 | A1 | 12/2020 | Moss | |
| 2022/0010582 | A1 * | 1/2022 | Westfahl | E04H 17/20 |

FOREIGN PATENT DOCUMENTS

| | | | |
|---|---|---|---|
| CN | 110424816 | A | 11/2019 |
| FR | 1354069 | A * | 2/1964 |
| JP | 2587825 | Y2 | 12/1998 |
| WO | 9726429 | A1 | 7/1997 |
| WO | 2007006068 | A1 | 1/2007 |
| WO | 2019148234 | A1 | 8/2019 |
| WO | 2020248015 | A1 | 12/2020 |

OTHER PUBLICATIONS

Lee, Hun Gil, International Search Report, dated Sep. 3, 2021, 4 pages, Korean Intellectual Property Office, Korea.

Lee, Hun Gil, Written Opinion of the International Searching Authority, dated Sep. 3, 2021, 7 pages, Korean Intellectual Property Office, Daejeon, Korea.

State Power Grid Anhui Electric Power Co., Ltd., A Kind of Protective Net Railing, This is a machine translation of a foreign patent originally published as CN110424816A on Nov. 8, 2019 in China.

Tokyo Seiko Co., Ltd., Interlocking Bracket For Cable-Type Protective Fence For Multi-Story Parking Lot, This is a machine-translation of a foreign patent originally published as JP2587825Y2 on Dec. 24, 1998 in Japan.

* cited by examiner

FOLDING SUPPORT ASSEMBLY FOR FENCE SYSTEMS

CROSS-REFERENCES

This application claims the benefit of U.S. Provisional Application No. 62/704,414 filed 8 May 2020.

TECHNICAL FIELD

This disclosure generally relates to fencing supports and parts for entering the ground, and more specifically to a folding corner assembly for efficient deployment of fence supports, specifically corner assemblies and endpoints.

BACKGROUND OF THE INVENTION

It is commonly said that good fences make good neighbors, but fences can be time consuming to install, requiring much labor. Corner assemblies are one of the main structural elements of a fence. Corner assemblies are commonly made from eight-foot-tall posts having a diameter of eight-inches. Corner assemblies are built by digging holes for the end post and brace post in the ground. The direction that the fence travels requires a brace post (or second post) in addition to the end post. A horizontal brace is installed to form the H-brace corner assembly. A brace wire may connect the brace post to the end post. Installation of a corner assembly is laborious and time consuming, but important to the longevity and structural soundness of the fence.

SUMMARY OF THE INVENTION

We recognized that a fence post system having a folding corner assembly could be installed quicker, with fewer workers, and with fewer errors than traditional fence systems. Installation of existing fence end points is laborious and requires skill and experience. It may take someone unfamiliar with the construction of a fence corner three to five times longer to complete the task than an experienced worker. To become proficient generally may require the construction of 10-20 corners. Our fence system with folding corner assembly dramatically improves the user experience and produces a result that looks good even when lacking prior knowledge or skill. This fence system with folding corner assembly can work with two stranded barbed wire, two strand barbless wire, woven wire, welded wire, plastic fence materials, high tensile wire, Gaucho® barbed wire, cable materials, multi-strand materials, electric fence, and invisible fencing. Traditionally, building materials for corner or end posts such as posts, braces and wires are transported separately to a work site. The corner assembly is then assembled on site.

An advantage of the current disclosure is increased portability of the folding corner assembly compared with a traditional corner assembly. This allows the folding corner assembly to be easier to ship or transport. Reducing the per unit shipping volume—or alternatively, increasing the packing factor (number of units per shipping container)—has numerous advantages in a modern economy where the equipment is manufactured a long way away from the installation site. Being able to ship the folding corner assembly enables installation at remote locations, because shipping costs per unit are decreased when additional units can fit in a shipping container. For one example, a folding corner assembly—including two sleeves, a riser post, a stretch mechanism, a brace, and angle supports—is approximately the same size as an eight-foot-tall post having a diameter of eight-inches, which requires a second post and braces to be functional.

We also recognized that a sliding stretch mechanism provides the advantages of decreasing the time needed to initially stretch the wires and also allows easy maintenance. The stretch mechanism allows all five wires to behave as one unit. If there is a general loosening or tightening of wires, tightening of two or more tensioner bolts between the stretch mechanism and the support post will tighten all wires. This allows the operator to tighten all wires simultaneously rather than individually tightening each wire. Alternatively, one tensioner may be tightened more or less than a second tensioner to tighten or loosen a group of wires relative to an upper end and lower end of the stretch mechanism.

We also recognized that the folding corner assembly could be used on multiple soil types. Lower adapter "deadman plates" are positioned at a lower portion of the post sleeve of a first support, with larger adapter plates easily installed thereto for sandy or gravely soil. Default plate may have an 11" diameter. A larger lower adapter plate may have a 15" diameter for use in sandy or gravely soil.

"H Brace" corners can fail when proper tension is applied to the fence. The end post, sometimes referred to as the corner post, is held in the ground by its own weight and the friction between the portion of the post embedded in the ground and the surrounding soil. These forces are insufficient to counteract the horizontal pull of the wire. The most common solution is to add additional weight to the end post by increasing the diameter. Another way to increase weight is to set the end and brace posts in concrete. Each solution increases material and labor costs and increases the hazards of completing the job. According to the current disclosure, the lower plate (foot or "deadman plate") uses the weight of the soil to prevent the corner assembly or endpoint from being lifted out of the ground. The flat distributed surface of the vertically oriented support plate prevents horizontal movement of the corner assembly or endpoint. Similarly, a vertically oriented support plate on the second post sleeve of the second support efficiently distributes the horizontal load. Another advantage of the current disclosure is that in existing fencing solutions it is important to tamp the substrate around the end and brace posts. This repacking of the soil may account for approximately one-third of the time to construct the most common industry corner. The foot or "deadman plate" of the current disclosure avoids the need to repack or "tamp" the soil in around the posts, saving labor and time. Once the end and brace assemblies are in the ground, the installer simply refills the hole.

Obtaining a proper tension based on stretching the wires is also important for proper fence installation. A stretch mechanism slides along the brace to stretch each of the wires simultaneously. Markings on the brace indicate different stretch specification levels. Printed or electronic user guides allow the installer to determine an appropriate stretch specification level based on the terrain type, soil substrate type, and fence run length.

BRIEF DESCRIPTION OF DRAWINGS

Aspects are illustrated by way of example, and not by way of limitation, in the accompanying drawings, wherein.

DETAILED DESCRIPTION

Figure 1:
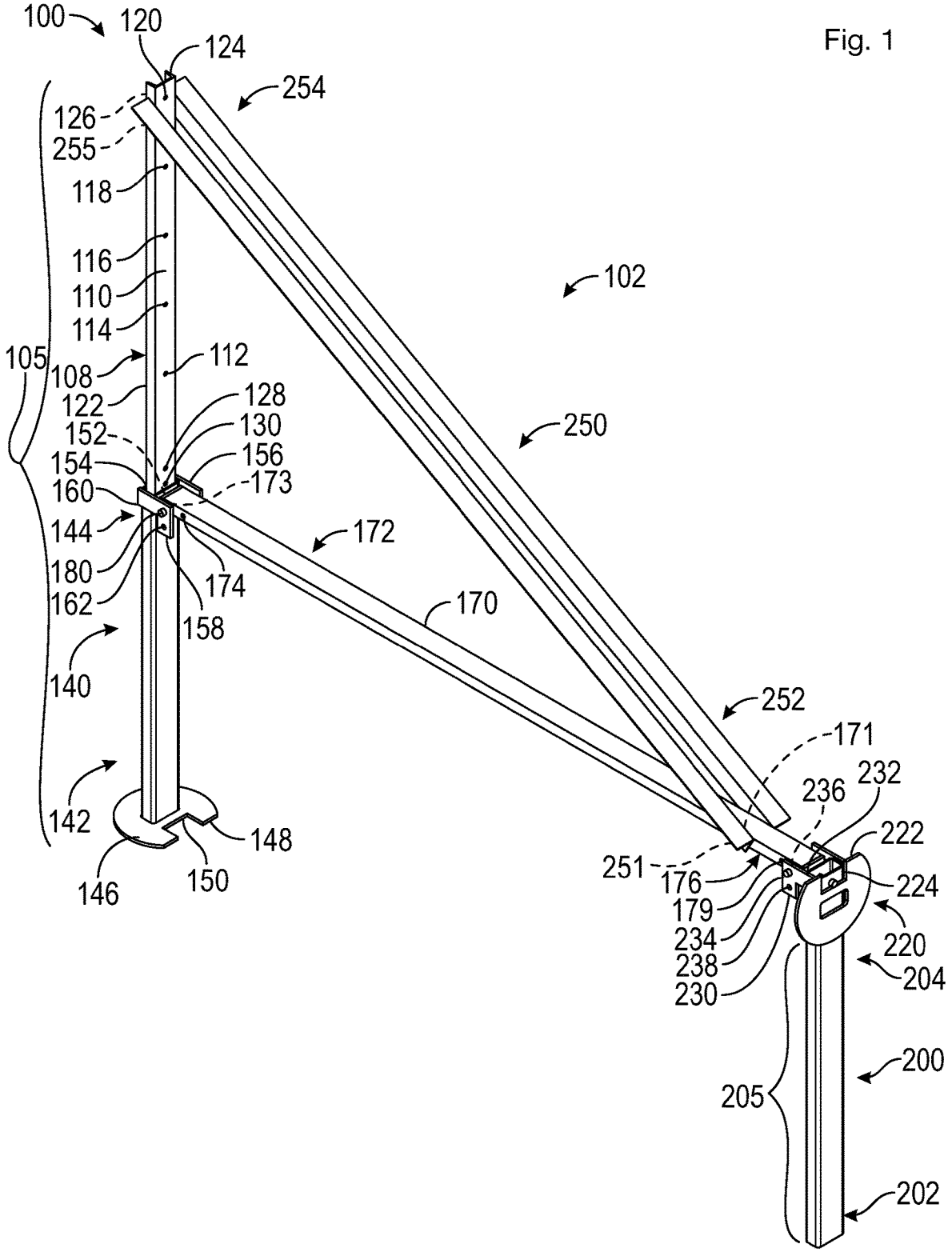
FIG. 1 depicts a side perspective view of a folding corner assembly in a deployed configuration.
Figure 2:
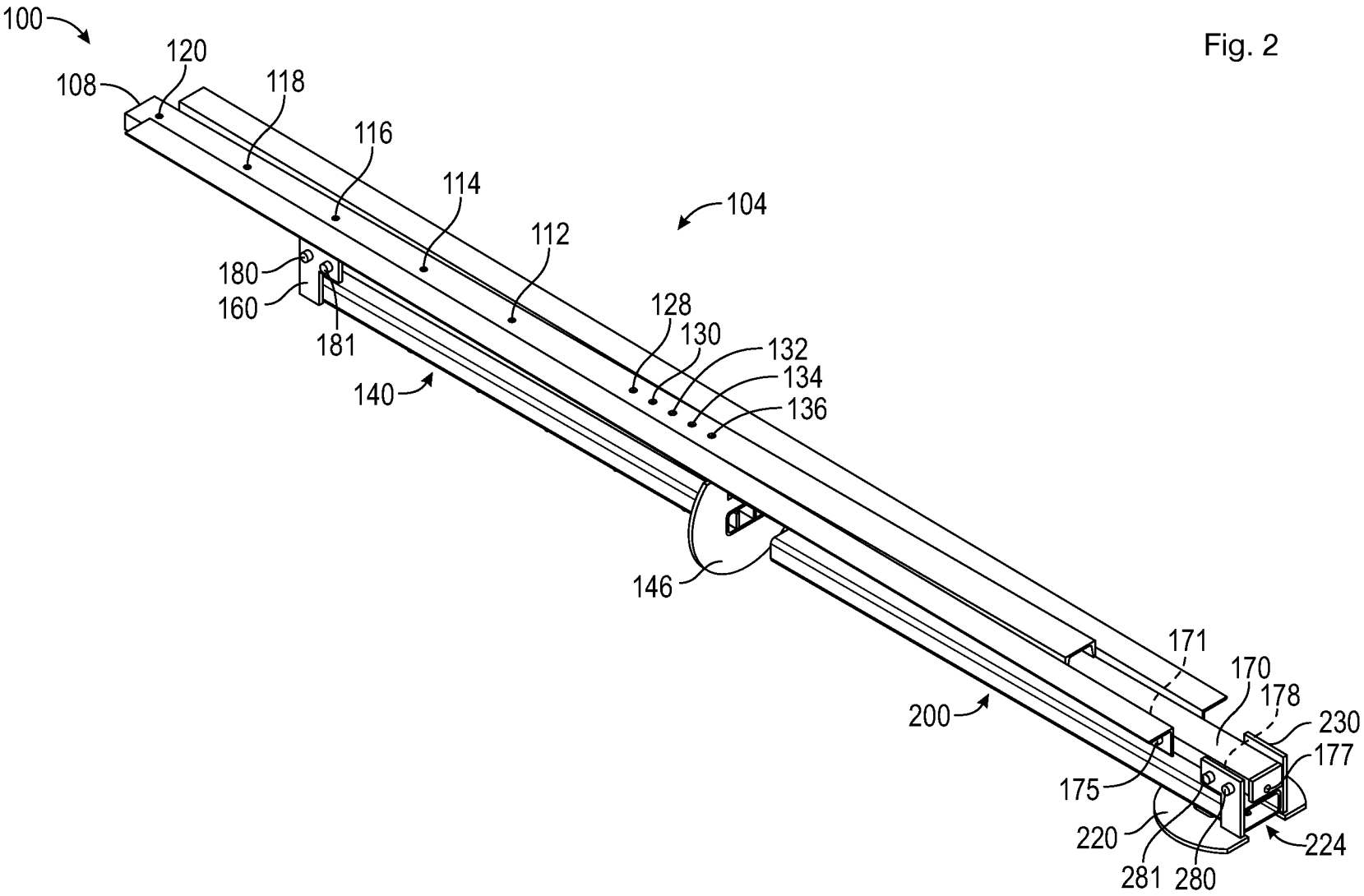
FIG. 2 depicts a side perspective view of the folding corner assembly of FIG. 1 in a storage configuration.

The fence post system 100 has a deployed configuration 102, shown in FIG. 1, and a storage configuration 104 shown in FIG. 2. In the storage configuration 104, the fence post system 100 is compact and ready for shipping being approximately the size of one 8' long and 8" diameter top creosote post. In another example, the fence post in the stored configuration is approximately 9' long and 14" side square. In the storage configuration, two or more generally flat sides may exist on the outside surface of the fence post system 100 to allow for self-leveling and flat contact points between a plurality of fence post systems placed into storage together. In one example, a pallet of sixteen fence post systems may be stowed within an approximately 9' by 56" by 56" right rectangular prism shape. In the deployed configuration 102, the fence post system 100 can support a variety of fence wire types including two stranded barbed wire, two strand barbless wire, woven wire, welded wire, plastic fence materials, high tensile wire, Gaucho® barbed wire, cable materials, multi-strand materials, electric fence, and invisible fencing. A corner assembly is the portion of the fencing system that includes start points, end points, and any kind of junction point. Junction points can be configured to continue a fence in any number of directions, with approximately 90° junctions being common. Used in this way, the term "corner assembly" comprises end points where a single set of fence wires approaches, as well as junction points where two or more sets of fence wires approach. There are circumstances where a fencing system has a junction point for four different fencing directions, and others where two or more fencing wire sets may join together at an angle equal to or other than 90°, such as 30° or 120° depending on the land to be fenced. The corner assemblies are generally installed in pairs, where a first corner assembly is a starting point, and a second corner assembly is the end point. A corner assembly junction point can serve as a starting or end point for multiple partner corner assemblies.

As shown in FIG. 1, a first support 105 may comprise a first post riser 108 that is inserted into a first post sleeve 140 to provide a support for the wire fence. The first post riser 108 may have a generally u-shaped cross section with a base 110, a first sidewall 122 extending perpendicular to the base 110, and a second sidewall 124 extending perpendicular to the base 110 opposite the first sidewall 122. Alternatively, the first post riser 550 may have a generally cylindrical cross section. A plurality of longitudinally spaced apart holes 112, 114, 116, 118, 120 may be disposed through the base 110 of the first post riser 108. Each of the plurality of longitudinally spaced apart holes 112, 114, 116, 118, 120 is configured to receive one of the fence wires. A first-riser-cross-brace-pivot pin slot 126 is disposed through the first sidewall 122 and the second sidewall 124 to facilitate mounting the angle support 250, as discussed below. The first post riser 108 has a plurality of first-riser-height pin slots 128, 130, 132, 134, 136 longitudinally space apart along the first post riser 108 through the base 110. The plurality of first-riser-height pin slots 128, 130, 132, 134, 136 allow the post riser to be set at varying heights, discussed in greater detail below.

A first post sleeve 140 is partially inserted into the ground and is configured to receive and support the first post riser 108. The first post sleeve 140 has a first lower sleeve portion 142 configured to be inserted into the ground and a first upper sleeve portion 144 that is maintained above the ground. A first deadman plate 146 optionally extends radially from the first lower sleeve portion 142. The first deadman plate 146 may have a first flat edge 148 with a notch 150. Additionally, the first deadman plate 146 may have a second flat edge opposite the notch 150 side of the deadman plate to aid in leveling and packaging of the folding corner assembly in the storage configuration 104. The first post sleeve 140 may have a rectangular or cylindrical cross section with a hollow center. Alternatively, the first post sleeve 140 may have a cross section complimentary to the cross section of the first post riser 108. The first post sleeve 140 has an upper opening 154 through which the first post riser 108 can be inserted into the hollow center of the first post sleeve 140. The first post sleeve 140 is configured to receive the first post riser 108 through the upper opening 154 and into the hollow center. A first-post-riser-sleeve-height pin slot 152 is disposed through the first upper sleeve portion 144.

The first post riser 108 of the first support 105 is configured to slide vertically within the first post sleeve 140 to adjust the height of the first post riser 108 above the ground. The first post riser 108 may have a longitudinal length of less than 72 inches. The first post riser 108 may be between 60 inches to 65 inches in length. The first post riser 108 is secured at a certain height by passing a first pin (not shown) through a selected one of the plurality of first-riser-height pin slots 128, 130, 132, 134, 136 and the first-post-riser-sleeve-height pin slot 152. The first pin secures the first post riser 108 at a given height. The height of the first post riser 108 may be set to varying heights depending on the terrain and the species or breed of animal to be contained within the fence.

A first brace bracket 160 is mounted to the first upper sleeve portion 144 in order to connect the first brace 170 to the first post sleeve 140. The first brace bracket 160 comprises a first brace bracket portion 156 extending perpendicular to the longitudinal axis of the first post sleeve 140 and a second brace bracket portion 158 mounted to the first brace bracket portion 156. The second brace bracket portion 158 extends parallel to the longitudinal axis of the first post sleeve 140. A first-bracket-pivot pin slot (not shown) is disposed through the second brace bracket portion 158. A first-bracket-storage pin slot 162 disposed in the second brace bracket portion 158 is longitudinally spaced apart from the first-bracket-pivot pin slot.

A first brace 170 is shown in FIG. 1 as a horizontal structural element connecting the first post sleeve 140 to the second post sleeve 200. The first brace 170 has a first end 172 selectively pivotally mounted to the first brace bracket 160 by positioning a second pin 180 through the first-bracket-pivot pin slot. A first-brace-first-riser-height pin slot (not shown) is disposed in the first end 172 of the first brace 170. A first-brace-first-pivot pin slot 173 is disposed adjacent to the first end 172 in order to pivotally mount the first brace 170 to the first brace bracket 160. A first-brace-first-storage pin slot 174 is disposed through the first brace 170 at a position longitudinally spaced apart from the first-brace-first-pivot pin slot 173 along the longitudinal axis of the first brace 170.

The first brace 170 as shown in FIG. 1, has a second end 176 configured to mount to the second post sleeve 200. A first-brace-second-riser-height pin slot 177 is disposed in the second end 176 to secure a second post riser (not shown) at an appropriate height. The second end 176 of the first brace 170 is selectively pivotally mounted to the second brace bracket 230 by positioning a second pin 280 through the second-bracket-pivot pin slot. A first-brace-second-pivot pin slot 178 is disposed adjacent to the second end 176 in order to pivotally mount the first brace 170 to the second brace bracket 230. A first-brace-second-storage pin slot 179 is disposed through the first brace 170 and is longitudinally spaced apart from the first-brace-second-pivot pin slot 178 along the longitudinal axis of the first brace 170. In order to connect the angle support 250 to the first brace 170, a first-brace-cross-brace-pivot pin slot 171 is disposed between the first end 172 and the second end 176.

The first brace 170 is configured to be pivoted relative to the first post sleeve 140 of the first support 105 to the storage configuration 104 wherein the first brace 170 is parallel with the first post sleeve 140 and the first brace 170 is received into the notch 150 of the first deadman plate 146. The first brace 170 is also configured to be pivoted relative to the first post sleeve 140 of the first support 105 to the deployed configuration 102 wherein the first brace 170 forms an angle with the first post sleeve 140 between 20° to 160°.

The first brace 170 can be secured in the storage configuration 104 by passing a third pin 181 through the first-bracket-storage pin slot 162 and the first-brace-first-storage pin slot 174. Locking the first brace 170 to the first post sleeve 140 allows the folding corner assembly to be more easily transported by stacking the first brace 170 and the first post sleeve 140 in line with each other. The first post sleeve 140 may have a longitudinal length of approximately half of the longitudinal length of the first brace 170 to facilitate inline stacking with multiple post sleeves. In one example, the first post sleeve 140 is approximately 4 feet and the first brace 170 is approximately 8' in length. The first post sleeve 140 may be less than 48" in length. The first post sleeve 140 may be between 39" to 42" in length. The first brace 170 may be between 96" to 144" in length.

A second post sleeve 200 of the second support 205 may be configured to receive a second post riser (not shown). The second post sleeve 200 may have a rectangular or cylindrical cross section. The second post sleeve 200 has a second lower sleeve portion 202 configured to be inserted into the ground. The second post sleeve 200 has a second upper sleeve portion 204 configured to be installed above the ground. A load plate 220 is mounted to the second upper sleeve portion 204. The load plate 220 is shown having a first flat edge 222 and may have a first notch 224 in the first flat edge 222. The second post sleeve 200 has a longitudinal length of approximately half of the longitudinal length of the first brace 170, so that in the storage configuration 104 the first post sleeve 140 and the second post sleeve 200 can be pivoted parallel with the first brace 170. In one example, the second post sleeve 200 is approximately 4' and the brace is approximately 8' in length. The second post sleeve 200 may be less than 48" in length. The second post sleeve 200 may be between 39" to 42" in length.

A second brace bracket 230 is mounted to the second upper sleeve portion 204. The first brace 170 is configured to be pivotally mounted to the second brace bracket 230 at the second end 176 of the first brace 170. The second brace bracket 230 comprises a third brace bracket portion 232 extending perpendicular to the longitudinal axis of the second post sleeve 200. A fourth brace bracket portion 234 is mounted to the third brace bracket portion 232 and extends parallel to the longitudinal axis of the second post sleeve 200. A second-bracket-pivot pin slot 236 is disposed in the second brace bracket 230 at the junction between the third brace bracket portion 232 and the fourth brace bracket portion 234. A second-bracket-storage pin slot 238 is disposed in the fourth brace bracket portion 234. The second-bracket-storage pin slot 238 is longitudinally spaced apart from the second-bracket-pivot pin slot 236.

By attaching the first brace 170 to the second-bracket-pivot pin slot 236, the first brace 170 can pivot relative to the second post sleeve 200 between the storage configuration 104 and the deployed configuration 102. In the storage configuration 104, the first brace 170 is parallel with the second post sleeve 200 and longitudinally aligned with the first post sleeve 140. The first brace 170 is configured to be secured in the storage configuration 104 by passing a fifth pin 281 through the second-bracket-storage pin slot 238 and the first-brace-second-storage pin slot 179. In the deployed configuration 102, the first brace 170 forms between a 20° to 160° angle with the second post sleeve 200.

An angle support 250 provides structural support for the first post riser 108 in the deployed configuration 102. The angle support 250 can be folded down into the storage configuration 104 where the angle support 250 is generally inline with the first brace 170. The angle support 250 has a first angle support end 252 and a second angle support end 254. A cross-brace-first-pivot pin slot 251 is disposed through the angle support 250 at the first angle support end 252. The angle support 250 is configured to pivot relative to the first brace 170 by passing a sixth pin 175 through the cross-brace-first-pivot pin slot 251 and the first-brace-cross-brace-pivot pin slot 171. A cross-brace-second-pivot pin slot 255 is disposed through the angle support 250 at the second angle support end 254. As shown in FIGS. 1 and 2, the angle support 250 may comprise a pair of angle iron bars parallel to one another and mounted on either side of the first brace 170. The angle support 250 is configured to pivot between a first angle support position parallel to the first brace 170 in the storage configuration 104 and a second angle support position forming an acute angle with the first brace 170 by passing a seventh pin (not shown) through first-riser-cross-brace-pivot pin slot 126 and the cross-brace-second-pivot pin slot 255.

Figure 3:
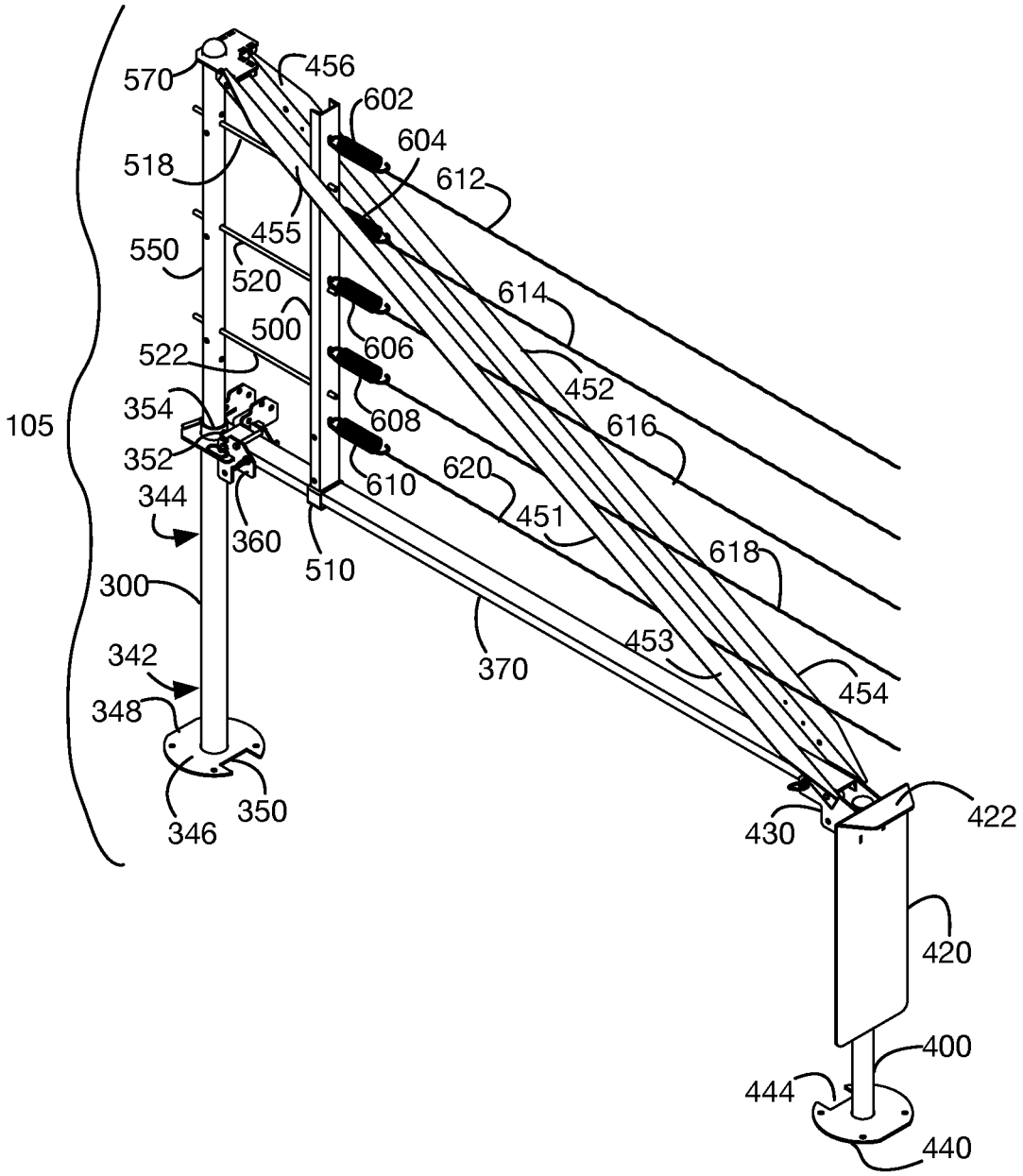
FIG. 3 depicts a side perspective view of a fence system with a folding corner assembly in a deployed configuration.

Another fence system with folding corner assembly is shown in FIG. 3. As illustrated, the first post sleeve 300 is inserted into a hole in the ground. The hole may be drilled with an auger or other post hole drilling method, to a diameter slightly larger than the first deadman plate 346. The first deadman plate 346 is mounted to the lower sleeve portion 342. The diameter of the first deadman plate 346 may be approximately 4 inches to 6 inches, and the diameter of the first deadman plate 346 may depend on the soil substrate type. A first deadman plate slot 350 is shown in the first deadman plate 346 so that in the storage configuration, the first post sleeve 300 can rotate tighter against the other components. Additionally, as shown in FIG. 2, the deadman plates 346, 440 may have a first flat edge 348 to aid leveling of the folding corner assembly in the storage configuration 104. At the upper sleeve portion 344, a first brace bracket 360 is mounted. The first brace bracket 360 is mounted through a pin and slot mechanism to the first brace 370. The pin and slot mechanism is advantageous because the brace may not be level at 90° depending on the terrain where the folding corner assembly is installed. At the upper sleeve portion 344 is an upper sleeve opening 354, configured to receive a portion of the first post riser 550. The majority of first post sleeve 300 is inserted into the ground and covered with a fill material. Buried components may be galvanized or stainless steel.

The first post riser 550 is installed above ground, and above ground components may be powder coated. The first post riser and post sleeves may be made of cylinder pipe material made of metal having thickness between ½" to ¼". Using thicker material in the post sleeves and thinner material for the first post riser may shift the weight of the folding corner assembly towards a lower half of the assembly when installed. Not wanting to be bound to theory, the shifted weight may lower the center of gravity on the folding corner assembly to increase overall stability of the fence system. The first post riser 550 extends generally in a straight line from first post sleeve 300. An upper brace bracket 570 is shown mounted to the upper portion of first post riser 550. The upper brace bracket 570 comprises a first upper brace bracket portion 571 and a second upper brace bracket portion 572 extending perpendicular to the longitudinal axis of the first post riser 550. The first upper brace bracket portion 571 extends parallel to the longitudinal axis of the first brace 370. The second upper brace bracket portion 572 extends perpendicular to the longitudinal axis of the first brace 370. The first brace 370 extends generally perpendicular to the first post sleeve 300 as shown in FIG. 3. Due to the first brace bracket 360 utilizing the pin and slot mounting system, in a real-world application the brace may extend at a variety of angles from the first post sleeve 300.

Similar to the first post sleeve 300, a second post sleeve 400 is mostly buried in the ground. A second deadman plate 440 is mounted to the lower portion of the second post sleeve 400. The second deadman plate 440 has a second deadman plate slot 444 to enable a compact storage configuration. The second deadman plate 440 may have a second flat edge on the other side of the post sleeve opposite the second deadman plate slot 444. The second post sleeve 400 also has a load plate 420. The load plate 420 is shown having a first flat edge 422 to aid in leveling and packaging of the folding corner assembly in the storage configuration 104. The load plate 420 is shown mounted to the second post sleeve 400 oriented in a plane tangential to the second post sleeve 400 and away from the first post sleeve 300. The second post sleeve 400 is inserted in to the second hole and buried to distribute the load once the fence wires are installed and tensioned.

A stretch mechanism 500 is mounted to the first brace 370 through a slide mechanism 510. The slide mechanism 510 is configured to guide movement of the stretch mechanism 500 along the longitudinal axis of the first brace 370. The stretch mechanism 500 extends generally perpendicularly from first brace 370. Alternatively, the stretch mechanism 500 can be mounted to the slide mechanism 510 using a slot and pin mechanism to enable installation on uneven or hilly terrain.

A first post riser 550 is installed into the first post sleeve 300. A first-post-riser-sleeve-height pin slot 352 is disposed through the first upper sleeve portion 344. The first post riser 550 is secured at a certain height by passing a first pin (not shown) through a selected one of the plurality of first-riser-height pin slots 328, 330 and the first-post-riser-sleeve-height pin slot 352 that is better illustrated in FIG. 13. Using the upper brace bracket 570 mounted at the upper portion of the first post riser 550, a first angle support 451 and a second angle support 452 are installed. The first angle support 451 is comprised of a first angle support lower member 453 and a first angle support upper member 455. The first angle support lower member 453 and the first angle support upper member 455 may be connected together using a slip joint that is better illustrated in FIG. 11. A cross-brace-second-pivot pin slot 457 is disposed through the first angle support 451 at the first angle support upper member 455. The first angle support 451 is installed by passing a pin through the cross-brace-second-pivot pin slot 457 and a first-riser-cross-brace-pivot pin slot (not shown) of the first upper brace bracket portion 571.

Figure 11:
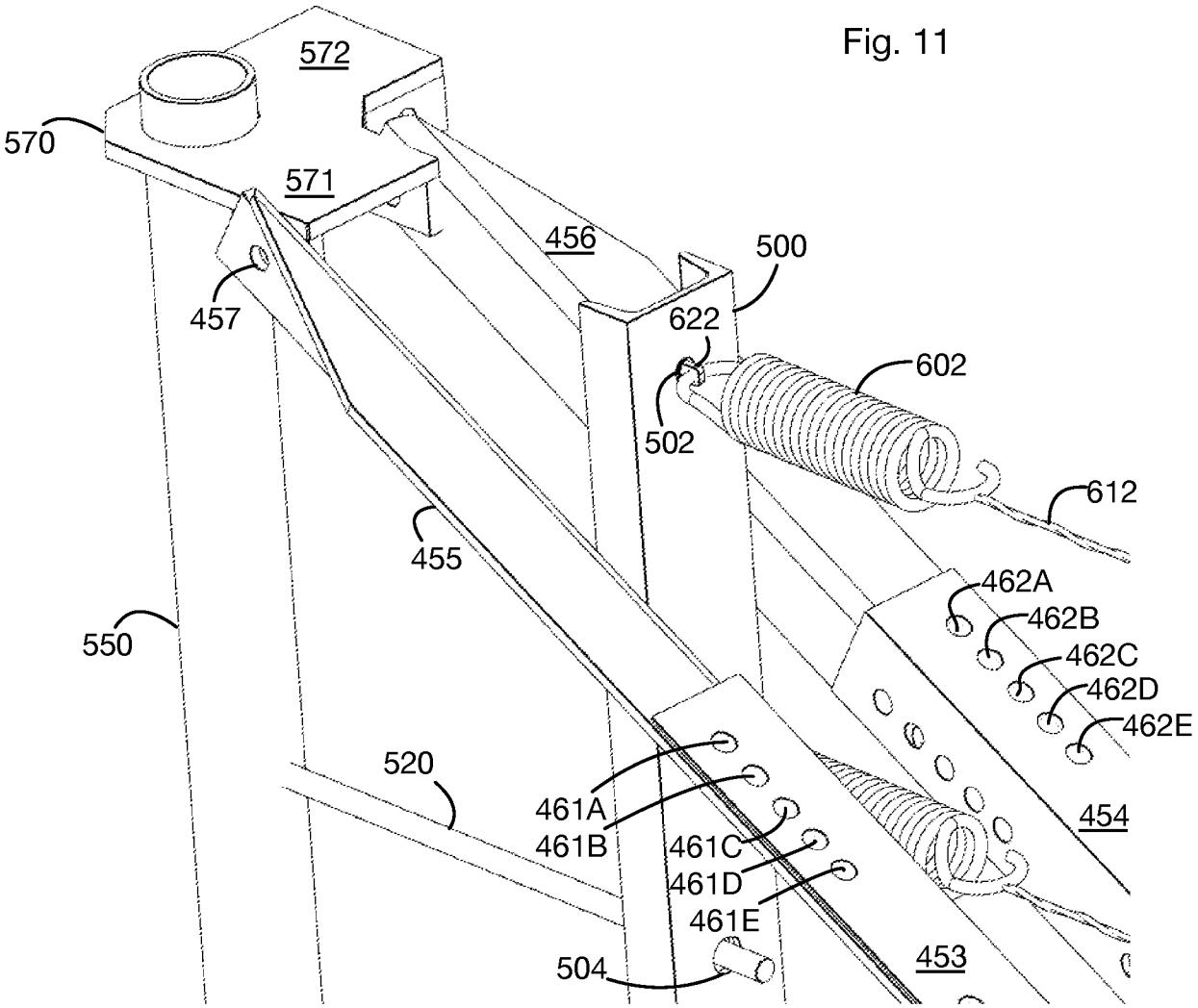
FIG. 11 depicts a side perspective view of a top portion detail of the riser post, including the slip joint and stretch mechanism of the folding corner assembly of FIG. 8.

Fence wires 612, 614, 616, 618, and 620 are connected to the stretch mechanism 500 through springs 602, 604, 606, 608, and 610. As shown more clearly in FIGS. 2 and 11, the stretch mechanism 500 has a plurality of holes 502, 503, 504, 505, 506, 507, 508, 509. The fence wires 612, 614 are shown connected to the springs 602, 604 connected to connectors 622. The remaining connectors and fence wires in FIG. 11 are not shown but operate similarly. The connector 622 passes through the hole 502 and secures the spring 602 to the stretch mechanism 500. To stretch the fence wires, the stretch mechanism 500 slides on the first brace 370 and then tightened using a come-along puller tool, such as a hand operated winch with ratchet. Once in position, tensioners 518, 520, 522 secure the stretch mechanism 500 to the first post riser 550. Tensioners 518, 520, 522 may be threaded rods that are secured by a nut after the threaded rod passes through one of the plurality of holes. Alternatively, the tensioners may be wire with any thread type secured between the first post riser and the stretch mechanism to maintain the position of the stretch mechanism.

Figure 5:
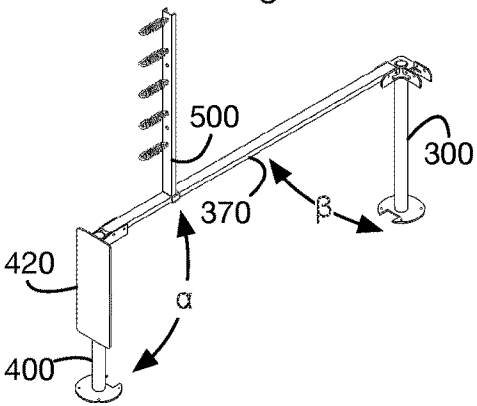
FIG. 5 depicts a partially deployed configuration of the folding corner assembly of FIG. 4 ready for insertion of the riser post.
Figure 4:
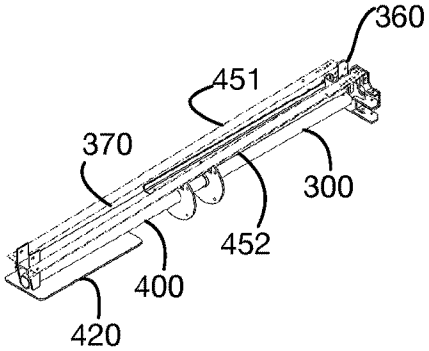
FIG. 4 depicts the shipping or storage configuration of a folding corner assembly.

FIGS. 4 through 8 illustrate the installation process. FIG. 4 shows the storage configuration. A folding corner assembly can be installed with the following process. FIG. 5 shows a partially deployed folding corner assembly. The second post sleeve 400 and the first post sleeve 300 are pivoted into its installation position. The first post sleeve is pivoted from a storage configuration where the first post sleeve is generally parallel to a first brace to a deployed configuration where the first post sleeve forms a first angle "α" with the brace that is between 30° to 120°. The second post sleeve is pivoted from a storage configuration where the second post sleeve is generally parallel to the first brace to a deployed configuration where the second post sleeve forms a second angle "β" with the brace that is between 30° to 120°. A stretch mechanism 500 is installed upon the first brace 370. The stretch mechanism is installed such that its slide mechanism receives the brace and can longitudinally slide thereupon. At this stage, the lower portions of the folding corner assembly, the first post sleeve and a second post sleeve, are inserted into a substrate, such as ground soil.

Figure 6:
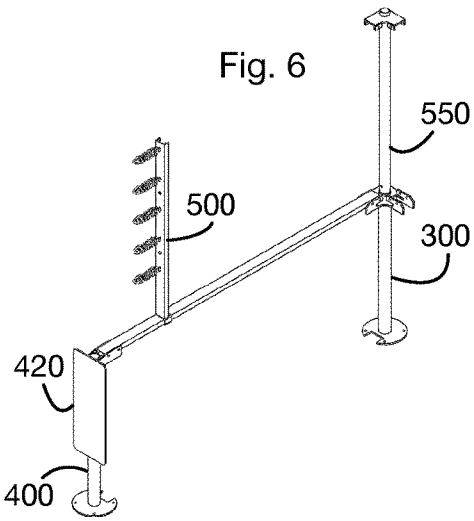
FIG. 6 depicts a partially deployed configuration of the folding corner assembly of FIG. 5 ready for attaching fence wires and installing angle supports.

FIG. 6 shows the first post riser 550 installed. The first post is inserted into the first post sleeve and secured in position. The stretch mechanism 500 is slid to a position near the first post riser 550 inserted into the second post sleeve 400.

Figure 7:
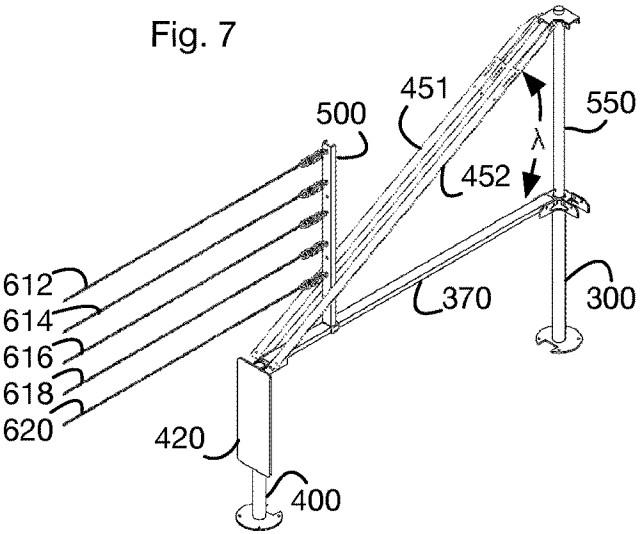
FIG. 7 depicts a deployed configuration of the folding corner assembly of FIG. 6 ready to stretch installed fence wires of the fence system.

FIG. 7 shows a first angle support 451 and a second angle support 452 installed between the top of the first post riser 550 and the top of the load plate 420. The angle support(s) is pivoted from an orientation parallel to the brace to form a third angle "λ" with the brace that is between 15° and 85°. The individual members of the angle support are extended to an appropriate length using the slip joint, which is then secured to the chosen length. Once the length of the first angle support 451 and the second angle support 452 are secured using the slip joints and fasteners, a triangle shape is formed providing structure while deadman plates 346, 440 and the load plate 420 provide load distribution. The fence wires 612, 614, 616, 618, 620 may be attached to the stretch mechanism via individual springs, which allow for contraction of the fence wires during cold weather and expansion of the fence wires during hot weather.

The type of terrain for installation may affect the choice in the selected spring mechanism for the fence wire tensioning process. Individual springs may be attached to the individual fence wires for tensioning by the stretch mechanism 500 on hilly terrain. Flat terrain may allow for a single spring mechanism that cooperates with the stretch mechanism 500 for tensioning all fence wires together. Individual springs may be directly connected to the stretch mechanism 500 through the holes in the stretch mechanism 500. The springs may be connected to the stretch mechanism 500 via connectors inserted through the hole and secured to the stretch mechanism. Once the wires are run, the stretch mechanism 500 is slid along the first brace 370 to the chosen stretch position marking on the first brace 370. Tensioners are installed between the end post and the stretch mechanism 500 to secure the position of the stretch mechanism 500 relative to the end post. Guide notches may be disposed in the posts along the fence line to be stretched. When fence wires are pulled together in the installation of the fence system the guide notches may be used to maintain separation between individual fence wires. Guide notches may prevent tangling by the unstretched fence wires during the installation process.

Figure 8:
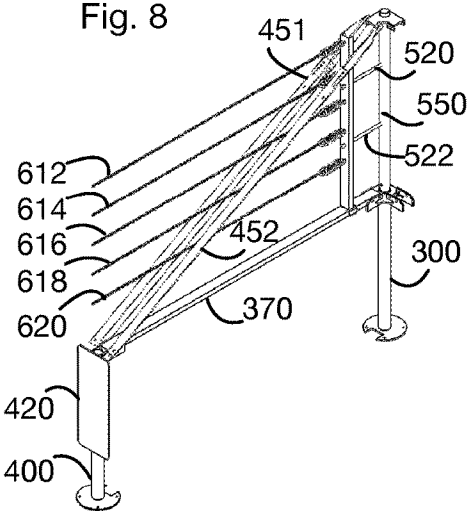
FIG. 8 depicts the folding corner assembly of FIG. 7 in the deployed configuration with the fence wires stretched, without showing the ground level.

FIG. 8 shows the fence wires 612, 614, 616, 618, 620 installed and the stretch mechanism 500 stretched into place and secured with tensioners 518, 520, 522. A wrap, such as fiberglass, may be installed to cover the gap or space between the stretch mechanism 500 and the first post riser 550. This wrap may be branded, for the fence manufacturer. Alternatively, the wrap can be customized for an end user. For example, the wrap can display a street address or lot number.

In applications where the fence wires are electrified, rubber washers may insulate the springs 602, 604, 606, 608, 610 or connectors. Alternatively, the stretch mechanism 500 may comprise a composite material that is non-conductive, such as a pultrusion fiberglass. Alternatively, the stretch mechanism 500 may comprise a single spring mechanism that pulls the stretch mechanism 500 into position near the first post riser 550 for stretching the fence wires 612, 614, 616, 618, 620 into place.

Figure 9:
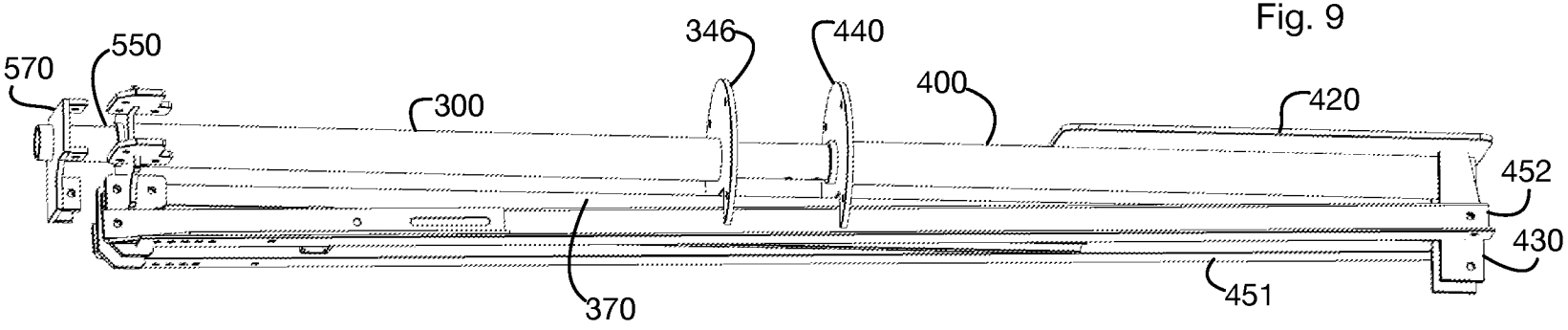
FIG. 9 depicts a side view of the folding corner assembly of FIG. 4 in a storage configuration.
Figure 10:
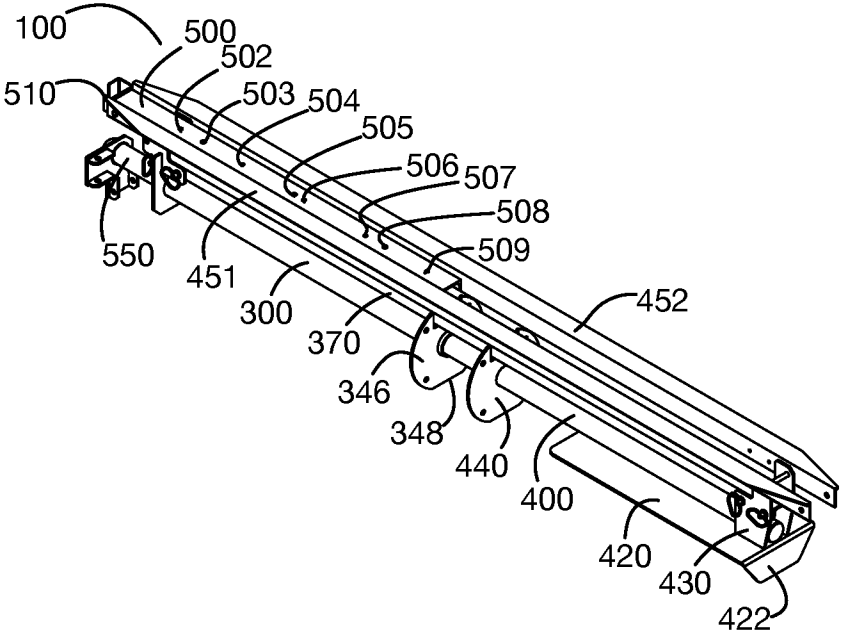
FIG. 10 depicts a side perspective view of the folding corner assembly of FIG. 3 in a storage configuration.

FIGS. 9 and 10 show different perspectives and examples of the storage configuration. Using pivot pin-operated mounting brackets, the second post sleeve 400 and first post sleeve 300 are configured to fold into a storage configuration 104 that is compact. The first deadman plate slot 350 and the second deadman plate slot 444 receive the first brace 370 in the storage configuration. The first post riser 550 passes through the first post sleeve 300 and second post sleeve 400. In one example, the first post riser 550 is approximately 8' in length and passes through the first post sleeve 300 and the second post sleeve 400 in the storage configuration 104. In another example, the first post riser 550 is approximately 6' in length and passes through the first post sleeve 300 and partially into the second post sleeve 400 in the storage configuration 104. Due to the slip joints, the first angle support upper member 455 and first angle support lower member 453 overlap longitudinally and are nestled together. Stretch mechanism 500 fits between first angle support 451 and second angle support 452. The angle supports may be removed and then installed. Alternatively, with a pivot mount between the angle support member and the lower brace bracket, the angle support may be pivoted from an orientation parallel to the first brace 370 to an angle between 15° and 85° from the first brace 370.

Figure 12:
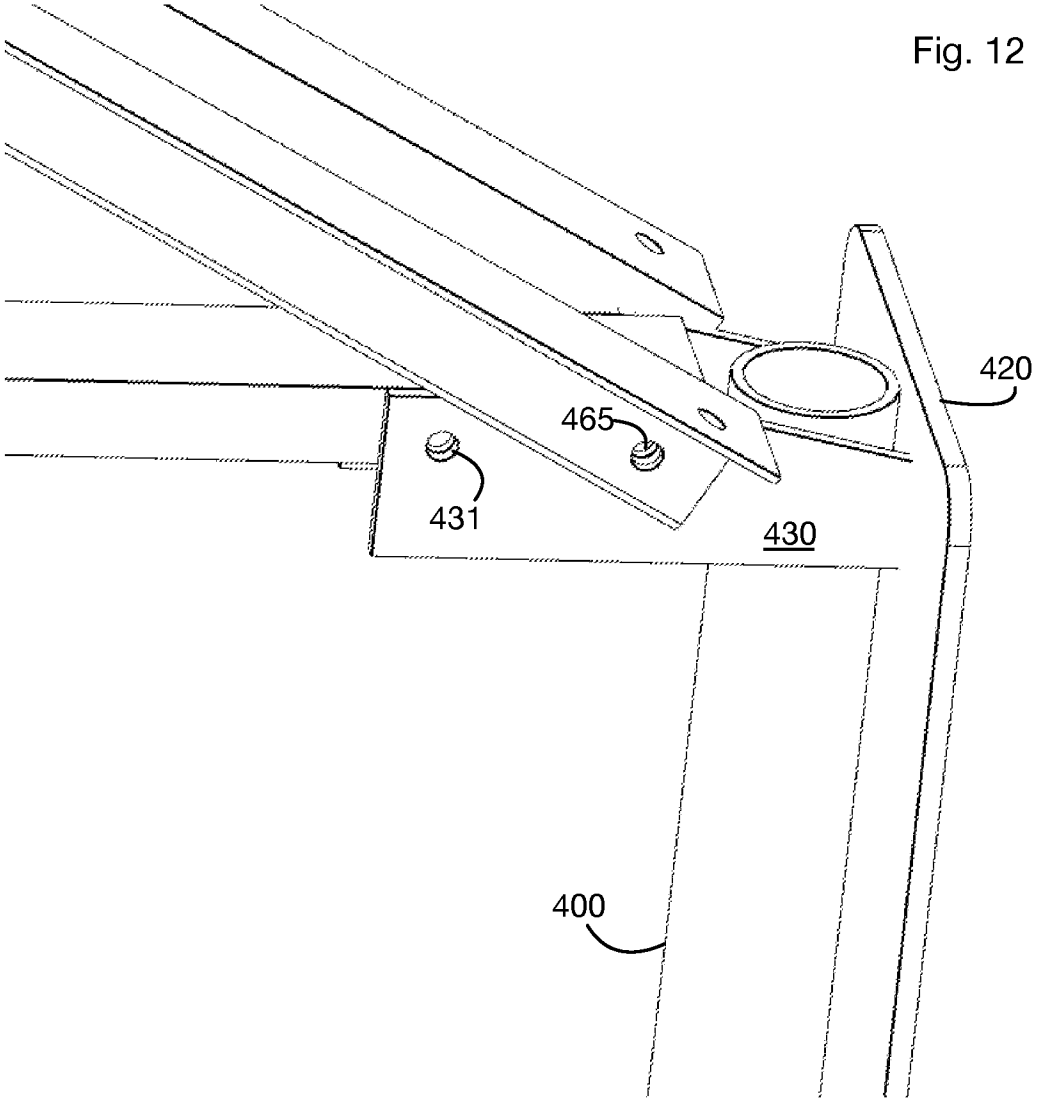
FIG. 12 depicts a side perspective view of a top portion detail of the second post sleeve of the folding corner assembly of FIG. 8.

As shown by close-up in FIG. 11, disposed through an upper end of first angle support lower member 453 and a lower end of first angle support upper member 455, are a plurality of slots 461A, 461B, 461C, 461D, 461E. Not shown in the graphic are one or more complementary slots in the first angle support upper member 455. This slip joint allows the first angle support 451 to be adjustable in length, allowing the angle bracket to extend between the upper brace bracket 570 and a second brace bracket 430 in a variety of terrains. A second angle support 452 also extends between the upper brace bracket 570 and the second brace bracket 430. The angle support is mounted to the second brace bracket 430 using a pin and slot pivot mechanism (slot and pin pivot mount) using slot 465, as shown in FIG. 12. The second angle support 452 has a second angle support lower member 454 and a second angle support upper member 456. The second angle support 452 also comprises a slip joint having a plurality of slots 462A, 462B, 462C, 462D, 462E.

As shown by close-up in FIG. 12, the first brace 370 is connected to the second brace bracket 430 mounted to the second post sleeve 400. The first brace 370 is mounted to the second brace bracket 430 through the slot and pin pivot mount using slot 465. In this way, the first brace 370 is allowed to pivot depending on the terrain to a position that is approximately parallel with the ground slope. For example, in a downhill fence installation location, the first brace 370 may be oriented on a downhill slant relative to the horizon. The second brace bracket 430 may secure the first brace 370 against pivotable movement by fastening a pin through slot 431 of the second brace bracket 430.

Figure 13:
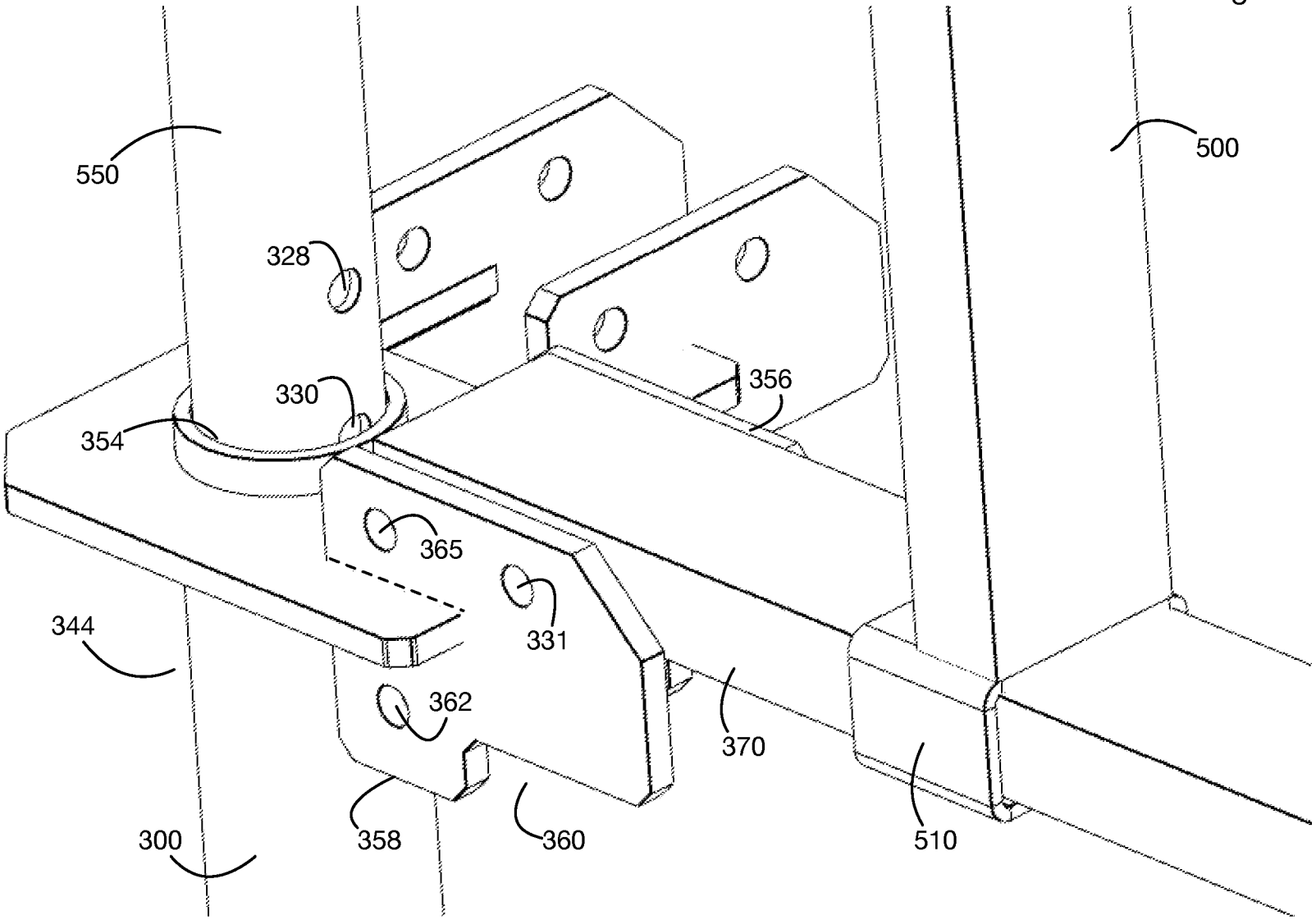
FIG. 13 depicts a side perspective view of a brace portion detail of the support and brace of the folding corner assembly of FIG. 8.

As shown by close-up in FIG. 13, the first brace bracket 360 is mounted to the first upper sleeve portion 344 to connect the first brace 370 to the first post sleeve 300. The first brace 370 is mounted to the first brace bracket 360 through the slot and pin pivot mount. In this way, the first brace 370 can pivot depending on the terrain to a position that is approximately parallel with the ground slope. For example, in a uphill fence installation location, the first brace 370 may be oriented on an uphill slant relative to the horizon. The first brace bracket 360 comprises a first brace bracket portion 356 extending perpendicular to the longitudinal axis of the first post sleeve 300 and a second brace bracket portion 358 mounted to the first brace bracket portion 356. The second brace bracket portion 358 extends parallel to the longitudinal axis of the first post sleeve 300. A first-bracket-pivot pin slot 365 is disposed through the second brace bracket portion 358. A first-bracket-storage pin slot 362 disposed in the second brace bracket portion 358 is longitudinally spaced apart from the first-bracket-pivot pin slot 365. The first brace 370 can be secured in the storage configuration 104 by passing a pin through the first-bracket-storage pin slot 362. The first brace bracket 360 may also secure the first brace 370 in the deployed configuration 102 by passing a pin through slot 331 of the first brace bracket 360.

Figure 14:
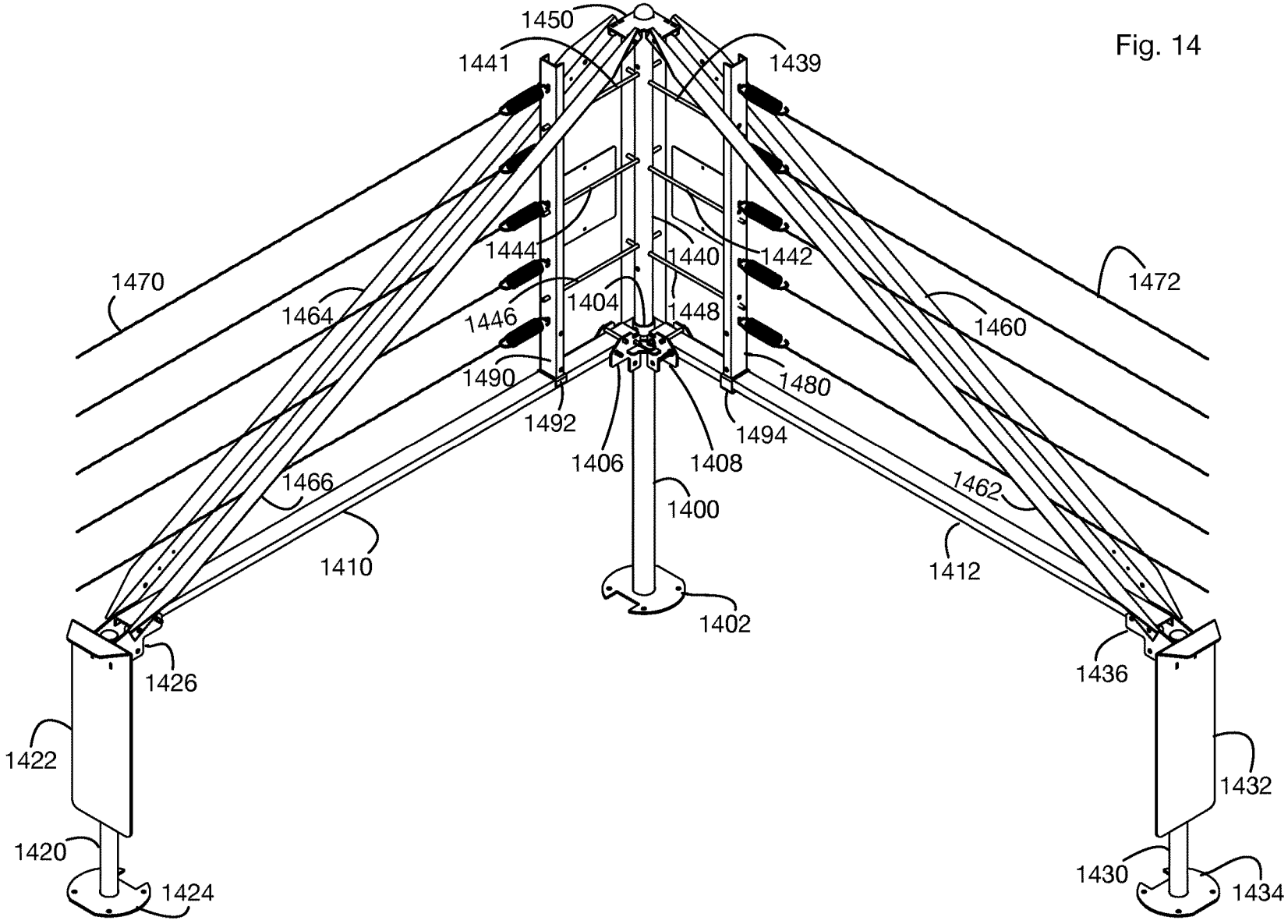
FIG. 14 depicts a fence system with a folding corner assembly junction with fence wires extending in two directions from the end post at approximately 90°, with the ground level not shown.

FIG. 14 depicts an end post installation where fence wires 1470, 1472 are extending in two directions. By adjusting the number of brace bracket ends 1406, 1408 of braces 1410, 1412 and an upper brace bracket 1450 of an end post 1440, any number of fence post wires can extend in any direction. As shown in previous embodiments, tensioner 1439, 1441, 1442, 1444, 1446, 1448 secure a stretch mechanism 1480, 1490 to the end post 1440. The stretch mechanism 1480, 1490 slides along the brace 1410, 1412 by means of the slide mechanism 1492, 1494 that guides the movement of the stretch mechanism. The braces are held between an end post sleeve 1400 and the post sleeves 1420, 1430 through the brace brackets 1426, 1436. The end post 1440 is inserted into the upper sleeve opening 1404. The end post sleeve 1400 and post sleeves 1420, 1430 are inserted into the ground. The load is distributed through deadman plates 1402, 1424, 1434 and load plate 1422, 1432. Angle supports 1460, 1462, 1464, 1466 provide structural support to the end post 1440.

Figure 15:
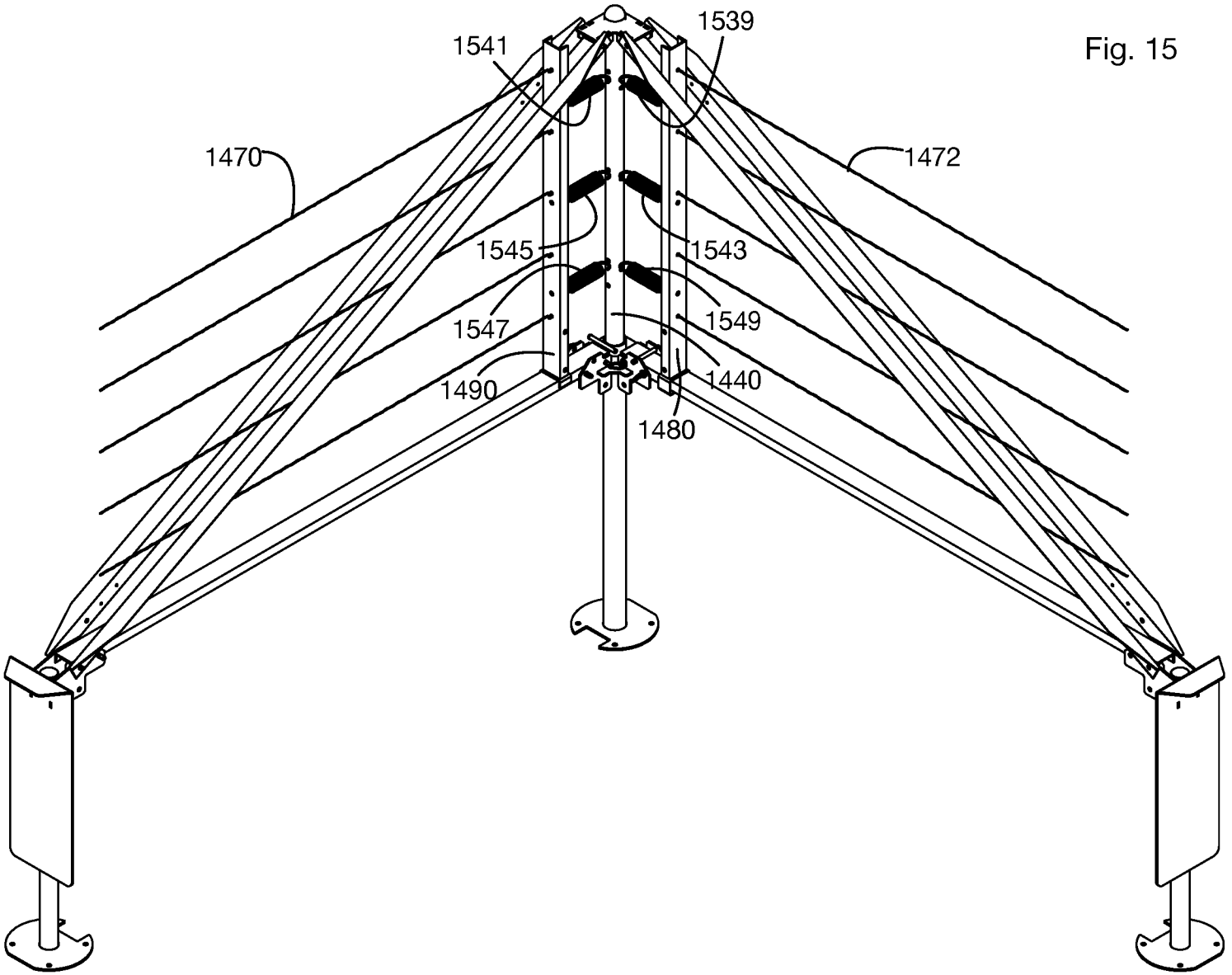
FIG. 15 depicts a fence system with a folding corner assembly junction with springs serving as tensioners between the stretch mechanism and the end post.

FIG. 15 depicts an alternative to the end post installation where fence wires 1470, 1472 are extending in two directions. The fence wires 1470, 1472 may be attached directly to the stretch mechanism 1480, 1490. Individual springs 1539, 1541, 1543, 1545, 1547, 1549 or a single spring mechanism may be installed between the stretch mechanism 1480, 1490 and the end post 1440 to allow for contraction and expansion of the fence wires. In this configuration, the springs may act as a tensioning mechanism in place of the tensioners.

Figure 16:
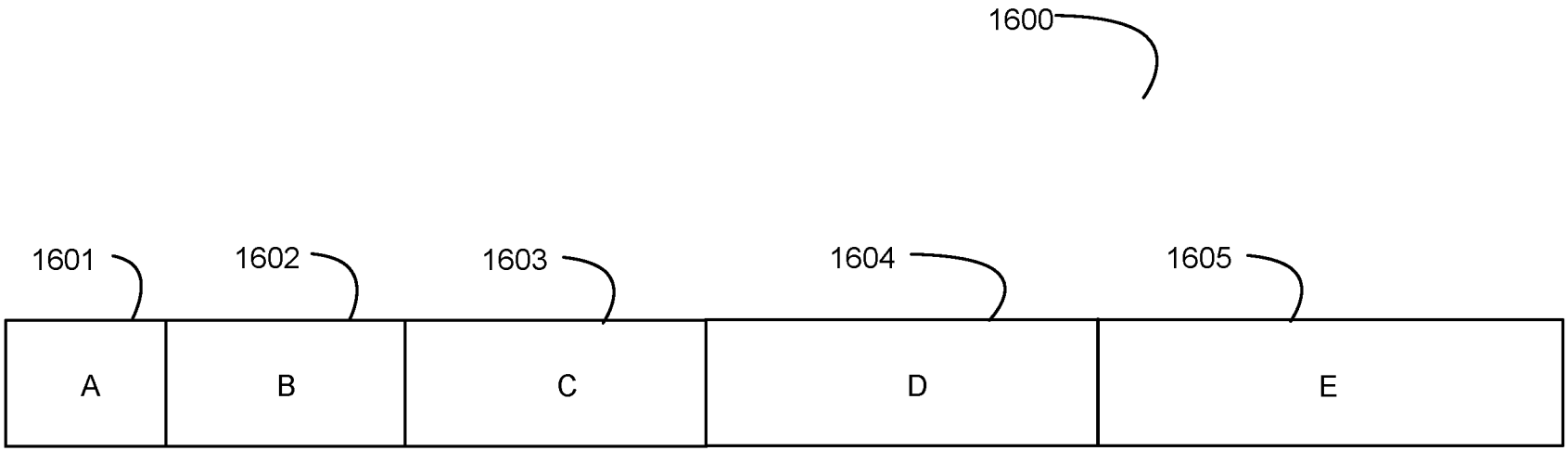
FIG. 16 depicts a face of the brace with markings indicating various stretch specification positions.

FIG. 16 shows a brace 1600 having a plurality of markings 1601, 1602, 1603, 1604, 1605 that are longitudinally spaced apart on the brace. The markings indicate a stretch specification for the stretch mechanism. As shown, the markings have varying sized zones or proportional lengths for stretch mechanism positioning. The markings indicate a stretch specification that increases in size and proportion from a corner side or endpoint of the brace, on the left in FIG. 16, to the extending fence system side of the brace, on the right in FIG. 16. The markings may correspond to a variety of factors, including a stress strain curve and a tensile strength factor of the wire specification. The markings may correspond to increasing stress strain on the fence wire in an exponential scale. Therefore, the indicated position of the stretch mechanism upon the markings may change as the distance and weight of the fence wire changes. An operator may follow user specifications, in the form of specification marking on the brace or through a user manual or app, to determine the appropriate final stretch position of the stretch mechanism. Different fencing and regional conditions may require different tension in the fence wires. Therefore, the user specifications may be tailored to a unique, individual installation site or geographic region. For example, longer fence runs may require extra tension relative to shorter fence runs. Certain types of soil or substrates may facilitate greater or less tension in the fence wire. For example, in sandy soil a post sleeve may not stay in place under increased tension in the fence wire. Additionally, the type of terrain and elevation change for installation may affect the chosen fence wire tension. Hilly terrain may require increased fence wire tension relative to fences installed on the flat plains.

A chart, diagram, or user guide may be provided with the folding corner assembly. The user guide is based on functions of fence installation terrain type, fence installation distance, climate at installation site, and properties of the fence wire such as a tensile strength factor. For example, an installer may use a guide based on stretch specification settings or ranges to reduce the amount of time spent in fence system tensioning. The guide may be based on equations related to yield strength of the fence wire where a stretch factor for the specific wire used is provided. The stretch factor may be based on a strain input value of the wire. The guide may direct the installer to stretch the fence wire to a designated stretch point. A stress string curve, based on wire properties, may be used in determining the stretch specification for marking placement of the final stretch point.

A fence system with a folding corner assembly can be installed with the following process. First a folding corner assembly is installed. A final stretch point specification may be based on a stretch distance calculation. One fence wire is stretched to the stretch specification marking on the brace. The stretched fence wire is used to establish a line for setting posts for the fence system. The stretch mechanism is unpinned. The remaining fence wires are pulled and connected to the stretch mechanism. The fence wires are pulled together to the stretch specification by the stretch mechanism.

To determine the appropriate stretch specification, the installer observes or records a variety of parameters including soil type, fence length, and terrain description. A printed guide or software application uses the fence installation location observations to calculate a recommended stretch specification. The recommended stretch specification corresponds to the plurality of markings 1601, 1602, 1603, 1604, 1605 on the brace 1600. The brace 1600 may have additional stretch specification markings. The plurality of markings are longitudinally spaced apart, on a longer or shorter sized brace. The user installs the fence wire to the stretch mechanism, as discussed above, and then stretches the fence wires by sliding the slide mechanism along the longitudinal axis of the brace via the slide mechanism. The user guide may define a start zone along the brace for a start push point. The user guide may also define an end zone along the brace for a final stretch point of the fence system. The start zone and end zone may correspond to the markings on the brace. The start zone may be variable based on the user guide, with the end zone being fixed. Alternatively, the end zone may be variable based on the user guide, with the start zone being fixed. Alternatively, both the end zone and the start zone may be variable based on the user guide. Alternatively, both the end zone and the start zone may be fixed based on the user guide. The distance the slide mechanism moves along the brace from the start push point to the final stretch point may be between 1' to 8' when stretching between an eighty to a quarter mile length of fence wire. Once the slide mechanism reaches the indicated marking on the brace, one or more tensioners are mounted between the post and the stretch mechanism to maintain the position of the stretch mechanism relative to the post. The tensioners may also be used for micro adjustment of the stretch mechanism or for releasing the stretch on the fence wires by the tightening or loosening of two or more tensioner bolts, respectively.

The chosen end zone (or final stretch point) may be determined based on a user guide as stated above. A software application, specifically an application installed on a mobile device having a Global Positioning System (GPS) or other position tracking sensors, may be used to automatically record and calculate the stretch specification. For example, the installer initializes a position recording feature. As the installer walks along the fence run, the software records the altitude changes and the length of the fence run. The software may determine the soil composition using location data accessed publicly or privately available through soil type maps. The software may prevent installer error in determining the stretch level specification. Alternatively, an application such as Google Earth may be used in determining a length of linear feet between a start peg and an end peg placement of the mapping application. Rough calculations may be based on use of the application in determining a quantity of materials needed and billed.

A stretch upgrade kit can be used to convert a traditional fence system. The stretch upgrade kit may include a marking bar. The marking bar has a plurality of markings indicating various stretch positions that may correspond to start zones and end zones, as may be indicated in a user guide. The marking bar may be freestanding. The marking bar may be mounted to a traditional fence attachment point, such as a first or second support post of a traditional fence start point, fence end point, H-brace corner assembly, or other corner post assembly. A sleeve may be incorporated on one end of the marking bar. The sleeve may receive the first support post. Alternatively, the marking bar may be attached to the first support post with fastening means used in traditional fence installations.

The stretch upgrade kit can also include a stretch mechanism. The stretch mechanism may be comprised of metal or plastic. The stretch mechanism may be a bar having a plurality of wire attachment points and a first tensioner attachment point. A plurality of fence wire types may be received and attached to the plurality of wire attachment points, as described above. The stretch mechanism may be configured to slide along a longitudinal axis of the marking bar with or without a slide mechanism. The marking bar guides positioning of the stretch mechanism from and to a chosen stretch specification (start zone to end zone, as described above).

The stretch upgrade kit can also include a first tensioner that secures the stretch mechanism to the traditional fence system, such as the first fence support post, the second support post, or both. The first tensioner may be constructed from a flexible material, rigid material, or a combination adjustably joined together. The first tensioner may be an acme screw, all thread rod, externally threaded bolt, tensioning rod or wire, linear actuator, or other bar having a length to span a distance between the stretch mechanism and the traditional fence attachment point. The first tensioner may be disposed through the first tensioner attachment point of the stretch mechanism.

The stretch mechanism may be secured to the first tensioner with a fastener such as a nut, wingnut, or other fastening means. The distance between the stretch mechanism and the traditional fence attachment point may be adjusted by tightening and loosening the fastening means upon the first tensioner.

The first tensioner, when positioned between the stretch mechanism and a second support post ("downstream" of the stretch mechanism), may be configured to push the stretch mechanism towards a first support post. Alternatively, the first tensioner, when positioned between the stretch mechanism and the first support post ("upstream" of the stretch mechanism), may be configured to pull the stretch mechanism towards the first support post.

The first tensioner is operated to push the stretch mechanism into the chosen stretch specification position based on the plurality of markings on the bar. As discussed above, a stress strain chart, a position tracking sensor, or a software application may be cross referenced to determine the stretch specification.

We claim:

1. A fence support assembly comprising:
- a. a first support;
- b. a second support; and
- c. a brace mounted between the first support and the second support and pivotable between:
  - i. a storage configuration wherein the first support and the second support are adjacently parallel with the brace; and
  - ii. a deployed configuration.

2. The fence support assembly of claim 1, wherein the deployed configuration the first support forms a first angle with the brace that is between 30° to 120° and the second support forms a second angle with the brace that is between 30° to 120°.

3. The fence support assembly of claim 1, wherein the first support comprises:
- a. a first post sleeve pivotally mounted to the brace;
- b. a first post riser received within the first post sleeve; and
- c. wherein the storage configuration a first length of the first support is not greater than a length of the brace, and in the deployed configuration the first post riser is configured to slide within the first post sleeve to adjust a second length of the first post riser relative to the first post sleeve.

4. The fence support assembly of claim 1, further comprising:
- a. an angle support pivotally mounted between the first support and the second support, the angle support comprises:
  - i. a slip joint configured to allow a length of the angle support to be extended and contracted.

5. The fence support assembly of claim 1, further comprising:
- a. a stretch mechanism extending upwardly from the brace.

6. The fence support assembly of claim 5, wherein the stretch mechanism comprises:
- a. a slide mechanism configured to receive the brace and guide movement of the stretch mechanism along a longitudinal axis of the brace.

7. The fence support assembly of claim 6, wherein the brace comprises a plurality of markings to indicate a stretch specification based on a parameter selected from a list of fence wire type, substrate type, fence run length, terrain type, temperature, and climate.

8. The fence support assembly of claim 7, wherein the plurality of markings are configured to guide movement of the stretch mechanism to a stretch position.

9. The fence support assembly of claim 5, further comprising:

a. a plurality of connectors secured to the stretch mechanism for mounting a plurality of fence wires.

10. The fence support assembly of claim 5, wherein the stretch mechanism is configured to move relative to the first support.

11. The fence support assembly of claim 1, further comprising:

a. a tensioner mounted between the first support and a stretch mechanism.

12. The fence support assembly of claim 1, further comprising:

a. a deadman plate extending outwardly from the first support; and b. a slot disposed in the deadman plate and configured to receive the brace in the storage configuration.

13. The fence support assembly of claim 1, wherein the first support is configured to pivot relative to the brace for insertion of the first support into a substrate.

14. The fence support assembly of claim 1, wherein the second support comprises:

a. a load plate mounted to the second support extending in a plane that is parallel to a longitudinal axis of the second support.

15. The fence support assembly of claim 1, wherein the first support and the second support are configured to pivot upon the brace.

16. A fence support assembly comprising:

a. a first support;

b. a second support;

c. a brace mounted between the first support and the second support; and d. a stretch mechanism extending upwardly from the brace and configured to slide along the brace.

17. The fence support assembly of claim 16, wherein the stretch mechanism comprises:

a. a slide mechanism configured to receive the brace and guide movement of the stretch mechanism along a longitudinal axis of the brace.

18. The fence support assembly of claim 16, further comprising:

a. a plurality of connectors mounted to the stretch mechanism for mounting a plurality of fence wires.

19. The fence support assembly of claim 16, further comprising:

a. a tensioner mounted between the first support and the stretch mechanism.

20. The fence support assembly of claim 19, wherein the tensioner is operable to adjust a distance between the first support and the stretch mechanism.

21. The fence support assembly of claim 16, wherein the first support comprises:

a. a first post sleeve pivotally mounted to the brace;

b. a first post riser received within the first post sleeve; and c. wherein in a storage configuration a first length of the first support is not greater than a length of the brace, and in a deployed configuration the first post riser is configured to slide within the first post sleeve to adjust a second length of the first post riser relative to the first post sleeve.

22. The fence support assembly of claim 16, wherein the first support and the second support are pivotally mounted to the brace and configured to pivot between a position adjacently parallel with the brace in a storage configuration and a deployed configuration between 30° to 120° from the brace.

23. The fence support assembly of claim 16, further comprising:

a. an angle support pivotally mounted between the first support and the second support, the angle support comprises:

i. a slip joint configured to allow a length of the angle support to be extended and contracted.

24. The fence support assembly of claim 16, wherein the brace comprises:

a. a plurality of markings that indicate a stretch specification.

25. The fence support assembly of claim 24, wherein a longitudinal spacing between the plurality of markings exists along the brace.

26. The fence support assembly of claim 25, wherein the longitudinal spacing between the plurality of markings is dependent upon a parameter selected from a list of fence wire type, substrate type, fence run length, terrain type, temperature, and climate.

27. The fence support assembly of claim 25, wherein the longitudinal spacing between the plurality of markings increase in size along the brace from the first support to the second support.

28. The fence support assembly of claim 16, wherein the second support comprises:

a. a load plate mounted to the second support and extending in a plane parallel to a longitudinal axis of the second support.

29. The fence support assembly of claim 16, wherein the stretch mechanism slides along the brace to stretch a plurality of fence wires simultaneously.

30. A fence support assembly comprising:

a. a first support;

b. a second support; and c. a brace mounted between the first support and the second support and pivotable between:

i. a storage configuration wherein the first support and the second support are adjacently parallel with the brace;

ii. a deployed configuration;

d. a stretch mechanism extending parallel with the first support and comprising:

i. a plurality of connectors configured to receive a plurality of fence wires; and e. a tensioner mounted between the first support and the stretch mechanism, wherein the tensioner is configured to move the stretch mechanism relative to the first support by adjusting a fastener upon the tensioner and maintain a final stretch position of the stretch mechanism relative to the first support.

31. The fence support assembly of claim 30, wherein the first support and the second support in the deployed configuration are between 30° to 120° from the brace.

32. The fence support assembly of claim 30, wherein the first support comprises:

a. a first post sleeve pivotally mounted to the brace;

b. a first post riser received within the first post sleeve; and c. wherein in the storage configuration a first length of the first support is not greater than a length of the brace, and in the deployed configuration the first post riser is configured to slide within the first post sleeve to adjust a second length of the first post riser relative to the first post sleeve.

33. The fence support assembly of claim 30, b. wherein the first support is configured to pivot relative to the brace for insertion of the first support into a substrate.

34. A method for installing a fence comprising the steps of:

a. unfolding a fence support assembly from a storage configuration wherein a first support and a second support are adjacently parallel with a brace;

b. attaching a plurality of fence wires to a stretch mechanism;

c. tensioning, simultaneously, the plurality of fence wires by moving the stretch mechanism relative to the first support with a tensioner;

d. securing the stretch mechanism to the first support at a final stretch point by adjusting a fastener upon the tensioner.

35. The method of claim 34, further comprising the step of:

a. adjusting a second length of the first support in a deployed configuration from a first length of the first support that is not greater than a length of the brace in the storage configuration.

36. A method for installing a fence comprising the steps of:

a. attaching a plurality of fence wires to a stretch mechanism;

b. tensioning, simultaneously, the plurality of fence wires by moving the stretch mechanism relative to a first support with a tensioner, wherein the stretch mechanism is configured to slide along a longitudinal axis of a brace extending from the first support;

c. securing the stretch mechanism to the first support at a final stretch point by adjusting a fastener upon the tensioner.

37. The method of claim 36, wherein the brace comprises a plurality of markings to indicate the final stretch point.

38. The method of claim 36, further comprising the step of:

a. sliding the stretch mechanism from a start push point to the final stretch point within a stretch specification based on a parameter selected from a list of fence wire type, substrate type, fence run length, terrain type, temperature, and climate.

* * * * *